US007731670B2

(12) United States Patent
Aguirre-Ollinger et al.

(10) Patent No.: US 7,731,670 B2
(45) Date of Patent: Jun. 8, 2010

(54) CONTROLLER FOR AN ASSISTIVE EXOSKELETON BASED ON ACTIVE IMPEDANCE

(75) Inventors: Gabriel Aguirre-Ollinger, Chicago, IL (US); Ambarish Goswami, Fremont, CA (US); J. Edward Colgate, Evanston, IL (US); Michael A. Peshkin, Evanston, IL (US)

(73) Assignees: Honda Motor Co., Ltd., Tokyo (JP); Northwestern University, Evanston, IL (US)

( * ) Notice: Subject to any disclaimer, the term of this patent is extended or adjusted under 35 U.S.C. 154(b) by 0 days.

(21) Appl. No.: 11/696,110

(22) Filed: Apr. 3, 2007

(65) Prior Publication Data

US 2008/0188907 A1 Aug. 7, 2008

Related U.S. Application Data

(60) Provisional application No. 60/888,035, filed on Feb. 2, 2007.

(51) Int. Cl.
*A61H 1/00* (2006.01)
*A61H 1/02* (2006.01)
*A61H 5/00* (2006.01)

(52) U.S. Cl. ..... 601/5

(58) Field of Classification Search ..... 601/5, 601/23, 27–35; 600/587, 595; 700/245
See application file for complete search history.

(56) References Cited

U.S. PATENT DOCUMENTS 5,101,472 A 3/1992 Repperger
5,551,308 A 9/1996 Arai et al.
7,190,141 B1 * 3/2007 Ashrafiuon et al. .... 318/568.12
7,204,814 B2 * 4/2007 Peles ..... 601/5
7,390,309 B2 * 6/2008 Dariush ..... 601/5
7,537,573 B2 * 5/2009 Horst ..... 601/5
2003/0115031 A1 * 6/2003 Dariush et al. ..... 703/11
2004/0102723 A1 * 5/2004 Horst ..... 601/5
2005/0070834 A1 * 3/2005 Herr et al. ..... 602/28
2006/0079817 A1 * 4/2006 Dewald et al. ..... 601/5
2007/0241696 A1 * 10/2007 Lauria et al. ..... 318/116
2008/0009771 A1 * 1/2008 Perry et al. ..... 600/587

(Continued)

OTHER PUBLICATIONS

H. Kazerooni et al, *On the Control of the Berkeley Lower Extremity Exoskeleton (BLEEX)*, Proceedings of the 2005 IEEE, International Conference on Robotics and Automation, Apr. 2005, pp. 4353-4360.

(Continued)

*Primary Examiner*—Justine R Yu
*Assistant Examiner*—Kristen C Matter
(74) *Attorney, Agent, or Firm*—Fenwick & West LLP; Mark E. Duell

(57) ABSTRACT

A system and method are presented to provide assist to a user by means of an exoskeleton with a controller capable of making the exoskeleton display active impedance. The exoskeleton assists the user by reducing the muscle effort required by the user to move his or her extremities. In one embodiment, a single-degree-of-freedom (1-DOF) exoskeleton assists a user with single-joint movement using an active impedance controller. In another embodiment, a multiple-degree-of-freedom (multi-DOF) exoskeleton assists a user with multiple-joint movement using an active impedance controller.

14 Claims, 14 Drawing Sheets

U.S. PATENT DOCUMENTS

2009/0149783 A1* 6/2009 Nef et al. ..... 601/5

OTHER PUBLICATIONS

H. Kazerooni et al, *That Which Does Not Stabilize, Will Only Make Us Stronger*, The International Journal of Robotics Research 2007, Jan. 2007, pp. 75-89, vol. 26, No. 1, Sage Publications.

Suwoong Lee et al, *Virtual impedence adjustment in unconstrained motion for an exoskeletal robot assisting the lower limb*, Advanced Robotics, Aug. 12, 2004, pp. 773-795, vol. 19, No. 7, VSP and Robotics Society of Japan.

Gabriel Aguirre-Ollinger et al, *Active-Impedence Control of a Lower-Limb Assistive Exoskeleton*, Proceedings of the 2007 IEEE 10th International Conference on Rehabilitation Robotics, Jun. 12-15, 2007, pp. 188-195.

Jerry E. Pratt et al, *The RoboKnee: An Exoskeleton for Enhancing Strength and Endurance During Walking*, Proceedings of the 2004 IEEE, International Conference on Robotics & Automation, Apr. 2004, pp. 2430-2435.

Kiyoshi Nagai et al, *Design of Robotic Orthosis Assisting Human Motion in Production Engineering and Human Care*, ICORR '99: International Conference on Rehabilitation Robotics, pp. 270-275.

Mitsunori Uemura et al, *Power Assist Systems based on Resonance of Passive Elements*, Proceedings of the 2006 IEEE/RSJ, International Conference on Intelligent Robots and Systems, Oct. 9-15, 2006, pp. 4316-4321.

Conor James Walsh et al, *Development of a lightweight, underactuated exoskeleton for load-carrying augmentation*, Proceedings of the 2006 IEEE International Conference on Robotics and Automation, May 2006, pp. 3485-3491.

PCT International Search Report and Written Opinion, PCT/US07/73093, Sep. 9, 2008, 10 Pages.

* cited by examiner

CONTROLLER FOR AN ASSISTIVE EXOSKELETON BASED ON ACTIVE IMPEDANCE

CROSS-REFERENCE TO RELATED APPLICATION

This application claims priority from the following U.S. provisional patent application, which is hereby incorporated by reference: Ser. No. 60/888,035, filed on Feb. 2, 2007, entitled "Controller for an Assistive Exoskeleton Based on Active Impedance."

BACKGROUND OF THE INVENTION

1. Field of the Invention

The present invention relates to controlling an exoskeleton such that it can provide forces to assist a user's motion. One use of these forces is to reduce the muscular effort involved in ordinary motions of the lower extremities, such as walking, climbing stairs, sitting down and standing up. Said forces can also enhance the user's agility of movement. More particularly, the present invention relates to an innovative form of exoskeleton control based on producing a virtual modification of the mechanical properties of the user's extremities.

2. Description of Background Art

Most of the current implementations of assistive exoskeletons are still at the stage of research and development. Commercially available exoskeletons do not yet exist, although a number of groups are working towards them. Most of the existing designs function well only within a laboratory environment and require extensive adjustment and tuning by specialized personnel.

Exoskeleton designs can be classified in terms of their assistive capabilities as either passive or active devices. A passive device is one that cannot deliver more energy to the environment than it has previously drawn from the environment. Springs are an example of a simple passive mechanical device. Exoskeletons that display passive behavior thus have a limited assistive capability. Specifically, they can help the user employ his own muscle power more effectively, but they don't actually supply energy to the user. (In fact, they always draw a certain amount of energy from the user.)

One example of exoskeleton-based passive assist is passive gravity support where the exoskeleton supports part of the user's weight. However, the exoskeleton cannot contribute to raise the user's center of gravity, for example when getting up from a chair. A special case of gravity support is load-carrying assist, in which the exoskeleton supports part of a load carried by the user, for example a heavy backpack. Another passive assist is a force-offsetting assist, where the exoskeleton uses passive devices like springs to offset forces from one healthy body joint (such as the hip) to another body joint that is relatively weak due to some condition (such as the ankle in patients suffering from drop-foot gait). In a resonance-based assist, the exoskeleton modifies the dynamics of the limb to make it function closer to its resonant frequency, thus helping make more effective use of the user's own muscle power.

Active devices on the other hand behave as energy sources. Thus an active exoskeleton has the capability of supplying energy to the user in a continuous way. This is important because, in order to make an exoskeleton an all-purpose assistive device, it should be capable of active behavior. Human movements involve the elevation of the center of mass of the body at one point or another. Only an active device can assist this kind of motion in a repetitive way. Additionally, human motion involves a non-negligible amount of energy dissipation through muscle tissue. An active exoskeleton would provide the capability to supplement part of the energy dissipated by the human body.

Control of an exoskeletal device is a challenging problem. In the case of active exoskeletons, the prevailing paradigm is myoelectrical control. This control scheme consists of using the muscles' electromyographical (EMG) activity to estimate muscle forces and multiplying the estimated forces by a certain gain. Thus the exoskeleton behaves as an amplifier of muscle forces. This type of control has the appeal of being useful, in principle, to assist any motion attempted by the human. On the other hand, it has several practical limitations, due mainly to the nature of the EMG signal. Accurate estimation of torque from EMG is a challenging task requiring the characterization of several muscles, plus separating extraneous components affecting the EMG signal. Furthermore, EMG displays considerable variability with time and across subjects.

There is a need for an exoskeleton control method that eliminates the need for EMG as a source for the control signal, yet provides the versatility of assist that comes from active behavior.

SUMMARY OF THE INVENTION

A system and method are presented to provide assist to a user by means of an exoskeleton with a controller capable of making the exoskeleton display active impedance. The exoskeleton assists the user by reducing the muscle effort required by the user to move his or her extremities.

In one embodiment, a single-degree-of-freedom (1-DOF) exoskeleton assists a user with single-joint movement using an active impedance controller. In another embodiment, a multiple-degree-of-freedom (multi-DOF) exoskeleton assists a user with multiple-joint movement using an active impedance controller.

BRIEF DESCRIPTION OF THE DRAWINGS

The invention is illustrated by way of example, and not by way of limitation, in the figures of the accompanying drawings in which like reference numerals refer to similar elements.

DETAILED DESCRIPTION OF THE EMBODIMENTS

Figure 1:
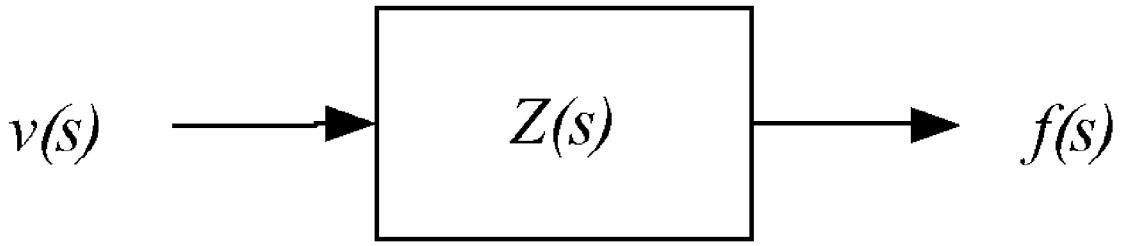
FIG. 1 illustrates a schematic representation of a mechanical impedance, according to one embodiment.

A preferred embodiment of the present invention is now described with reference to the figures where like reference numbers indicate identical or functionally similar elements. Also in the figures, the left most digits of each reference number corresponds to the figure in which the reference number is first used.

Reference in the specification to "one embodiment" or to "an embodiment" means that a particular feature, structure, or characteristic described in connection with the embodiments is included in at least one embodiment of the invention. The appearances of the phrase "in one embodiment" in various places in the specification are not necessarily all referring to the same embodiment.

Some portions of the detailed description that follows are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic or optical signals capable of being stored, transferred, combined, compared and otherwise manipulated. It is convenient at times, principally for reasons of common usage, to refer to these signals as bits, values, elements, symbols, characters, terms, numbers, or the like. Furthermore, it is also convenient at times, to refer to certain arrangements of steps requiring physical manipulations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or "determining" or the like, refer to the action and processes of a computer system, or similar electronic computing device, that manipulates and transforms data represented as physical (electronic) quantities within the computer system memories or registers or other such information storage, transmission or display devices.

Certain aspects of the present invention include process steps and instructions described herein in the form of an algorithm. It should be noted that the process steps and instructions of the present invention could be embodied in software, firmware or hardware, and when embodied in software, could be downloaded to reside on and be operated from different platforms used by a variety of operating systems.

The present invention also relates to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein, and any references below to specific languages are provided for disclosure of enablement and best mode of the present invention.

In addition, the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention, which is set forth in the following claims.

1. Active Impedance

Mechanical impedance is the relationship between the net forces acting on a mechanical system and the system's resulting velocity or, for the case of rotational motion, the relationship between net torque and angular velocity.

If the system is linear and time invariant, the impedance of the system can be expressed in compact form in the Laplace domain as the transfer function Z(s) relating the velocity v(s) to the net force f(s), as illustrated in FIG. 1. A second-order mechanical impedance is given by the expression $$Z(s)=ms+b+(k/s) \tag{1}$$

where the terms m, b and k represent, respectively, the mass, damping and stiffness (spring constant) of the system.

A physical system is said to be passive if the amount of energy $\Delta E_{out}$ that can be extracted from it over a certain period of time $\Delta t$ is never greater than the sum of the system's initial energy $E_o$, plus the amount of energy $\Delta E_{in}$ that entered the system during $\Delta t$:

$$\Delta E_{out} \leqq E_o + \Delta E_{in} \tag{2}$$

A passive impedance function Z(s) has no poles in the right half of the complex plane. In addition, any imaginary poles of Z(s) are simple, and have positive residues. Also, $\mathrm{Re}\{Z(j\omega)\} \geqq 0$ for all $\omega$. An active system, by contrast, is not subject to the above conditions. Thus an active system is one that can behave as a continuous energy source.

The relationship between passive or active behavior and energy transfer can be understood in terms of phase. Suppose the input velocity to the system illustrated in FIG. 1 is sinusoidal, where $v(t)=V \sin \omega t$ and V is a constant. The output force will show a phase shift $\phi$ relative to v(t) so that $f(t)=F \sin(\omega t+\phi)$ where F is a constant. It can be shown that the average power exchanged between the system and the environment is given by $P=(FV/2)\cos \phi$. A passive system is one in which the phase angle $\phi$ introduced by Z(s) has a value between −90° and +90°. In this case, the average power is positive, meaning that the system draws energy from the environment. The system will be active if the phase is either less than −90° or greater than +90°. In this case, the average power is negative, meaning that the system transmits energy to the environment.

Because of this phase angle condition, a passive system will possess positive impedance terms m, b and k. By contrast, an active system will possess a certain combination of negative impedance terms. Negative masses, dampers or springs do not normally occur in nature. Thus an active impedance cannot be generated from ordinary mechanical elements but requires an energy source plus control.

The control strategy focuses on enabling the exoskeleton to make the transition from passive to active behavior. During active behavior, the exoskeleton transmits energy to the user's limb. When the exoskeleton's behavior is passive, it draws energy from the user.

2. Assistive Control Based on Active Impedance: 1-DOF Case

The main concepts involved in assist through impedance control are explained using a simplified 1-DOF model of an exoskeleton. In one embodiment, this model is used to represent an exoskeleton designed to assist the motion of one of the leg's joints such as the knee joint. The desired assistive effect is to reduce the muscle torque at the joint by a given factor. Although the knee joint is used as an example, the exoskeleton and control strategy described herein can be used to assist any joint of any limb or extremity, such as the ankle, knee, or hip joint of a leg or the wrist, elbow, or shoulder joint of an arm. Also, the user can be a human or an animal. Additionally, for ease of explanation, the term "limb" may be used to describe a limb segment (such as a lower leg or an upper arm) attached to a joint of a limb.

Figure 2:
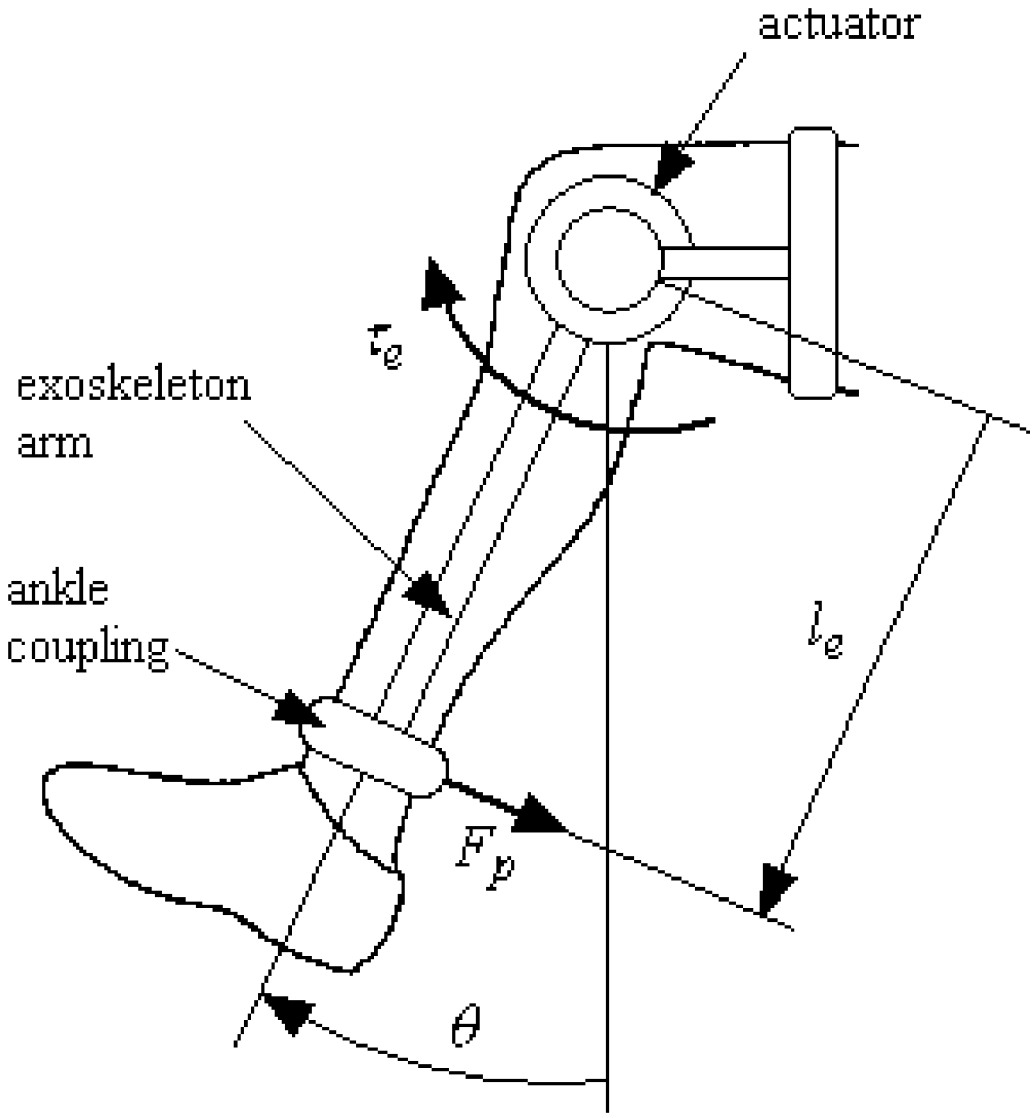
FIG. 2 illustrates a 1-DOF assistive exoskeleton for a knee joint, according to one embodiment.
Figure 3:
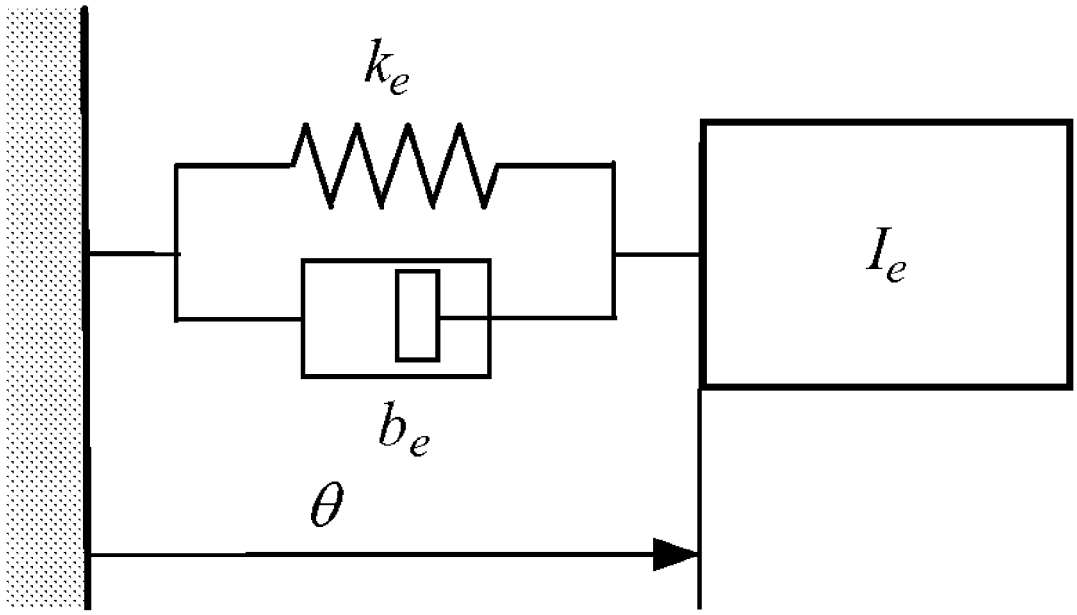
FIG. 3 illustrates a linear model of a 1-DOF exoskeleton, according to one embodiment.

FIG. 2 illustrates a 1-DOF assistive exoskeleton for a knee joint, according to one embodiment. The illustrated exoskeleton includes an actuator and an arm and is coupled to the ankle. A linear model of a 1-DOF exoskeleton with its impedance parameters is illustrated in FIG. 3, according to one embodiment. The exoskeleton's impedance parameters include an inertia moment $I_e$ (related to the exoskeleton's arm), a damping $b_e$, and a stiffness $k_e$. The "e" subscript refers to "exoskeleton." Coordinate $\theta$ represents the angular position of the actuator of the exoskeleton.

The terms $I_e$, $b_e$, and $k_e$ represent real mechanical properties of the exoskeleton. Since these properties are passive and constant, they are of limited usefulness to the wearer. The exoskeleton's control and actuation modifies the dynamic behavior of the exoskeleton, replacing it with a set of virtual impedance parameters $I_e^d$, $b_e^d$, $k_e^d$ that can serve to assist the human. The superscript "d" refers to "desired." This form of control is referred to as impedance control, and it can be implemented through kinematic state feedback and/or force feedback. The concept is illustrated in FIGS. 4A, 4B, and 4C, according to one embodiment.

Figure 4A:
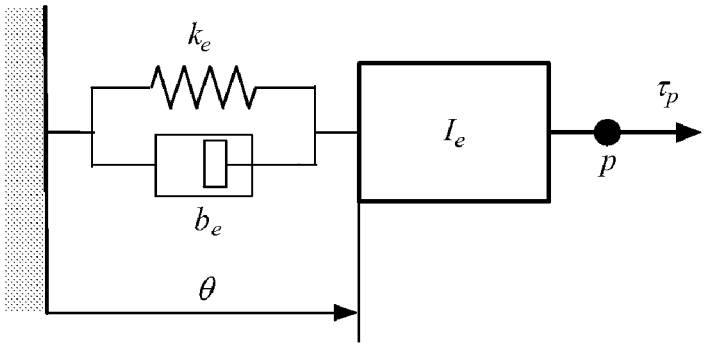
FIGS. 4A, 4B, and 4C illustrate generating virtual impedance parameters in an exoskeleton through impedance control, according to one embodiment.
Figure 4B:
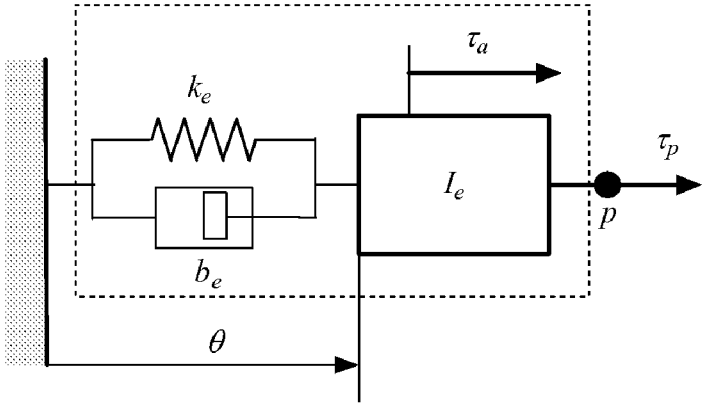
Figure 4C:
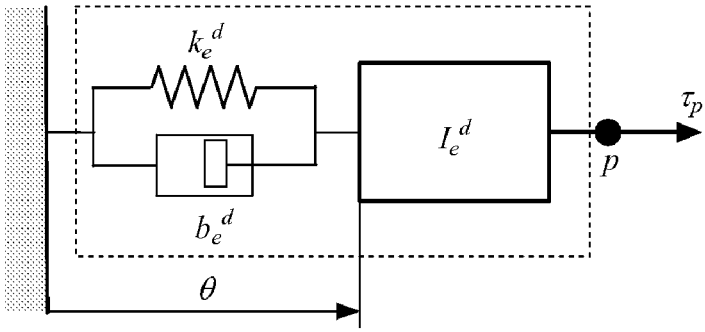

In FIG. 4A, the impedance felt by a user exerting a torque $\tau_p$ on the interaction port p of the exoskeleton is $Z_e(s)=I_e s+b_e+(k_e/s)$, that is, the natural impedance of the exoskeleton. The "p" subscript refers to the "interaction port p," a contact point between the user and the exoskeleton (e.g., the ankle coupling shown in FIG. 2). The interaction force $F_p$ is also illustrated in FIG. 2. $\tau_2=F_p l_e$, where $\tau_p$ represents the interaction torque. In FIG. 4B, the exoskeleton is subject to an actuator torque $\tau_a$ in addition to the user's torque $\tau_p$. The "a" subscript refers to the "actuator." The torque $\tau_a$ is exerted by the actuator depicted in FIG. 2. The control law governing torque $\tau_a$ is such that the user feels now a different, virtual impedance of $Z_e^d(s)=I_e^d s+b_e^d+(k_e^d/s)$. This virtual impedance is illustrated in FIG. 4C. From the user's perspective, the systems in FIGS. 4B and 4C have the exact same behavior.

Figure 5:
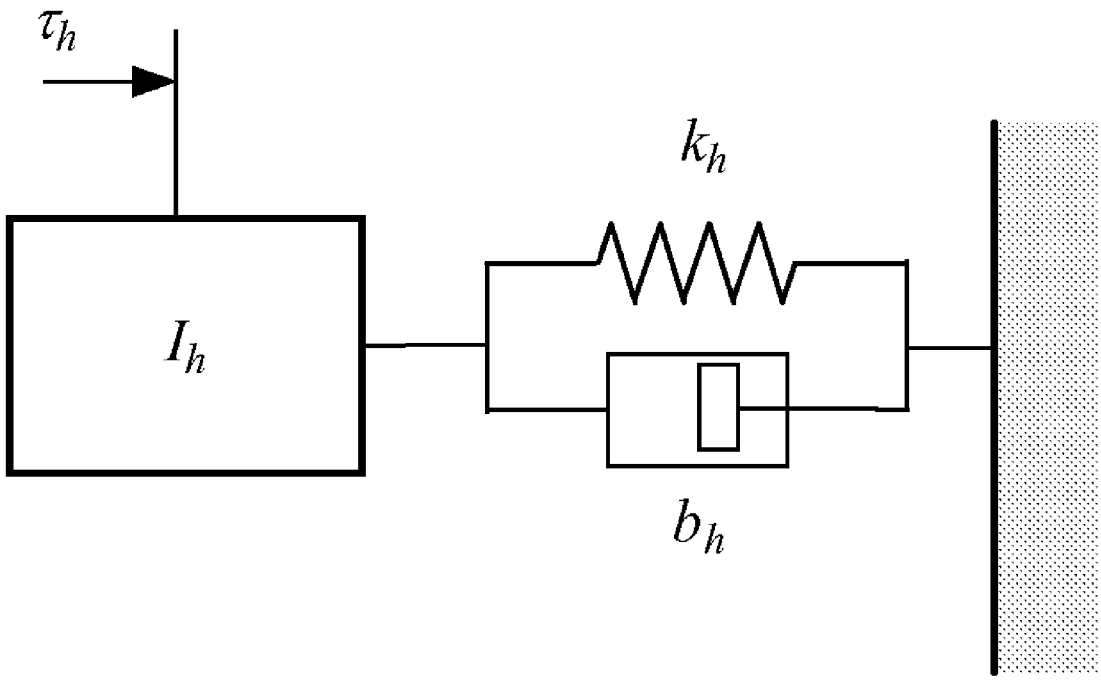
FIG. 5 illustrates a linear model of a human limb segment, according to one embodiment.

The interaction between the exoskeleton and the human user can be modeled in order to choose appropriate exoskeleton virtual impedance parameters that make the exoskeleton assistive to the user. FIG. 5 illustrates a linear model of the human limb segment, according to one embodiment. The limb's mechanical impedance comprises inertia moment $I_h$, damping $b_h$, and stiffness $k_h$. The "h" subscript refers to "human". The human limb's impedance is described as $Z_h(s)=I_h s+b_h+(k_h/s)$. When the exoskeleton is detached from the human limb, a certain muscle torque $\tau_h$ is needed in order to produce a desired velocity response $\omega_h$, per the following equation:

$$(I_h s+b_h+(k_h/s))\omega_h=\tau_h \tag{3}$$

The exoskeleton is designed to reduce this needed muscle torque by a certain factor G greater than 1. In other words, with the exoskeleton assisting the limb, the user need provide a muscle torque of only $\tau_h^*=\tau_h/G$ to execute the same velocity $\omega_h$. The rest of the necessary torque is provided by the exoskeleton. Thus it is expected that the exoskeleton's virtual impedance $Z_e^d(s)$ is an active impedance. The virtual impedance $Z_e^d(s)$ can vary over time, for example if $Z_h(s)$ or G varies with time.

Figure 6:
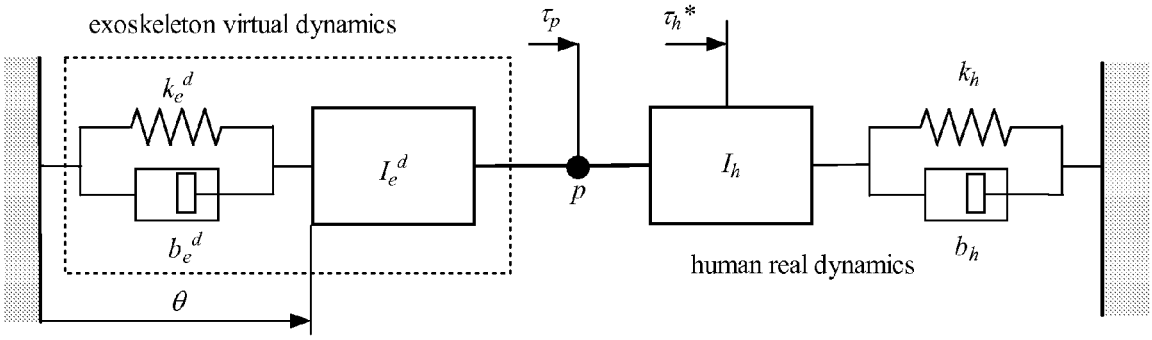
FIG. 6 illustrates a linear model of a system comprising a human limb segment attached to an exoskeleton, according to one embodiment.

FIG. 6 illustrates a linear model of the coupled system formed by the exoskeleton's virtual dynamics and the human limb segment, according to one embodiment. $\tau_p$ represents the torque exerted by the exoskeleton on the human at the interaction port p. Assuming a rigid coupling between the exoskeleton and the human, the equations governing the motion of the exoskeleton and the human are $$(I_h s+b_h+(k_h/s))\omega_h=\tau_h^*-\tau_p \tag{4}$$

$$(I_e^d s+b_e^d+(k_e^d/s))\omega_h=\tau_p \tag{5}$$

To achieve the stated control objective of scaling the needed muscle torque per $\tau_h^*=\tau_h/G$, we start by dividing each side of equation (3) by G:

$$(1/G)(I_h s+b_h+(k_h/s))\omega_h=\tau_h/G \tag{6}$$

or $$(1/G)(I_h s+b_h+(k_h/s))\omega_h=\tau_h^* \tag{7}$$

The virtual impedance parameters can be found by combining equations (4), (5) and (7). Thus the parameters are given by:

$$I_e^d s=I_h(1-G)/G \tag{8}$$

$$b_e^d=b_h(1-G)/G \tag{9}$$

$$k_e^d=k_h(1-G)/G \tag{10}$$

The human impedance terms can be estimated by an appropriate method such as system identification based on least-squares approximation. As can be seen, the virtual impedance terms of the exoskeleton must be negative in order to achieve a scaling of the muscle torque. Given this condition, the passivity condition $\mathrm{Re}\{Z_e^d(j\omega)\}\geqq 0$ does not hold. In consequence, $Z_e^d(s)$ is an active impedance.

The exoskeleton scales down the human limb's impedance by adding to it a virtual exoskeleton impedance $Z_e^d(s)$ that is out of phase by exactly 180°. The modified human limb impedance is given by $Z_h^d(s)$:

$$Z_h^d(s)=Z_h(s)+Z_e^d(s) \tag{11}$$

Figure 7:
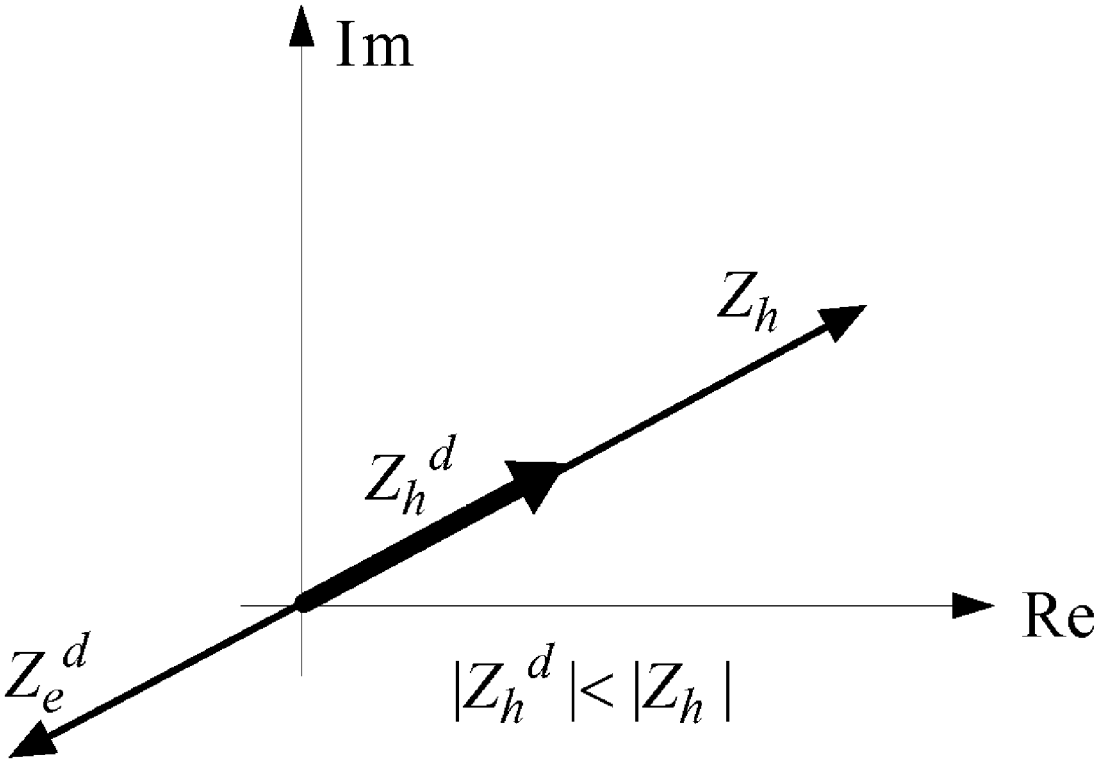
FIG. 7 illustrates applying active exoskeleton impedance for scaling of a human limb impedance, according to one embodiment.

The summation of impedances in the above equation is illustrated in FIG. 7 where the impedances are represented as vectors in a complex plane.

Thus the assistive effect of the exoskeleton can be described as replacing the original human limb impedance $Z_h(s)=I_h s+b_h+(k_h/s)$ by a "desired" human limb impedance $Z_h^d(s)=I_h^d s+b_h^d+(k_h^d/s)$, where the individual impedance terms are given by:

$$I_h^d=I_h+I_e^d \tag{12}$$

$$b_h^d=b_h+b_e^d \tag{13}$$

$$k_h^d=k_h+k_e^d \tag{14}$$

The torque-scaling method just described is not the only possible way to apply active impedance for assistive purposes. In general, the exoskeleton will be assistive, in the sense of reducing the average muscle torque, if it can make the magnitude of the human's virtual impedance less than the magnitude of the human's natural impedance. Thus for the case of a sinusoidal (oscillating) limb motion of frequency $\omega$, the exoskeleton's action will be assistive if the following relationship holds:

$$|Z_h^d(s)|_{s=j\omega}<|Z_h(s)|_{s=j\omega} \tag{15}$$

Figure 8:
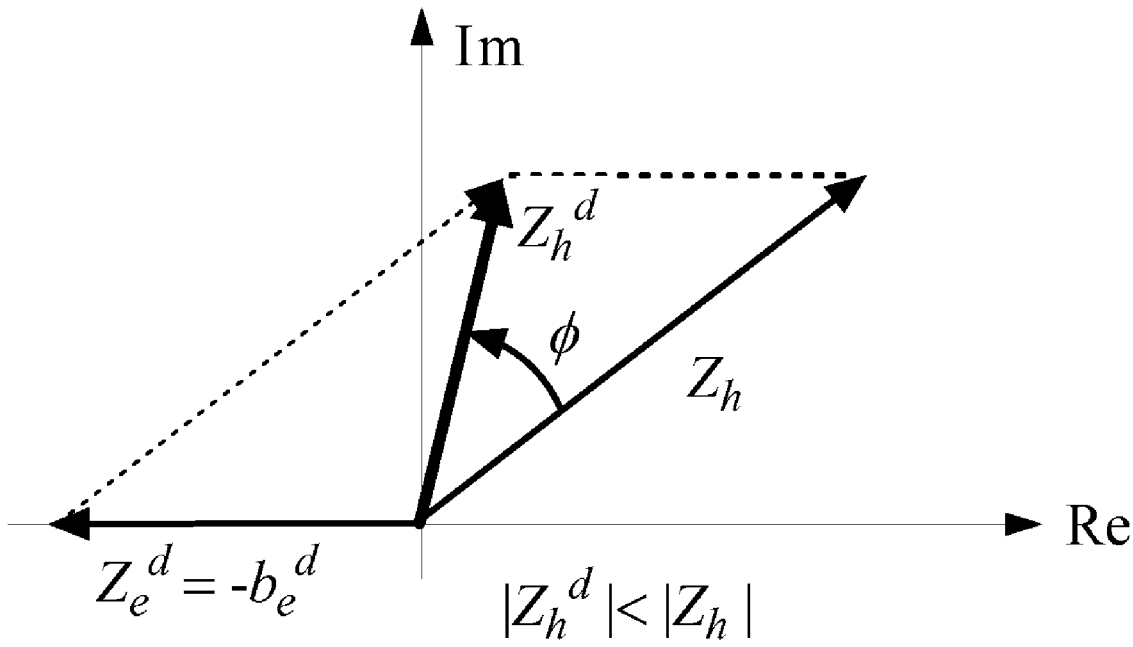
FIG. 8 illustrates the effect of pure negative damping on human limb impedance, according to one embodiment.

As an example of the previous statement, FIG. 8 illustrates the case in which a pure negative exoskeleton damping ($Z_e^d=b_e^d$, $b_e^d<0$) is connected to the human limb. This would have the effect of canceling part of the normal energy dissipation that occurs in the limb due to the passive damping of the muscle tissue. As FIG. 8 illustrates, the magnitude of the modified human limb impedance, $Z_h^d$, is less than that of the natural limb impedance, $Z_h$.

3. Implementation of a 1-DOF Assistive Controller Based on Active Impedance

Figure 9A:
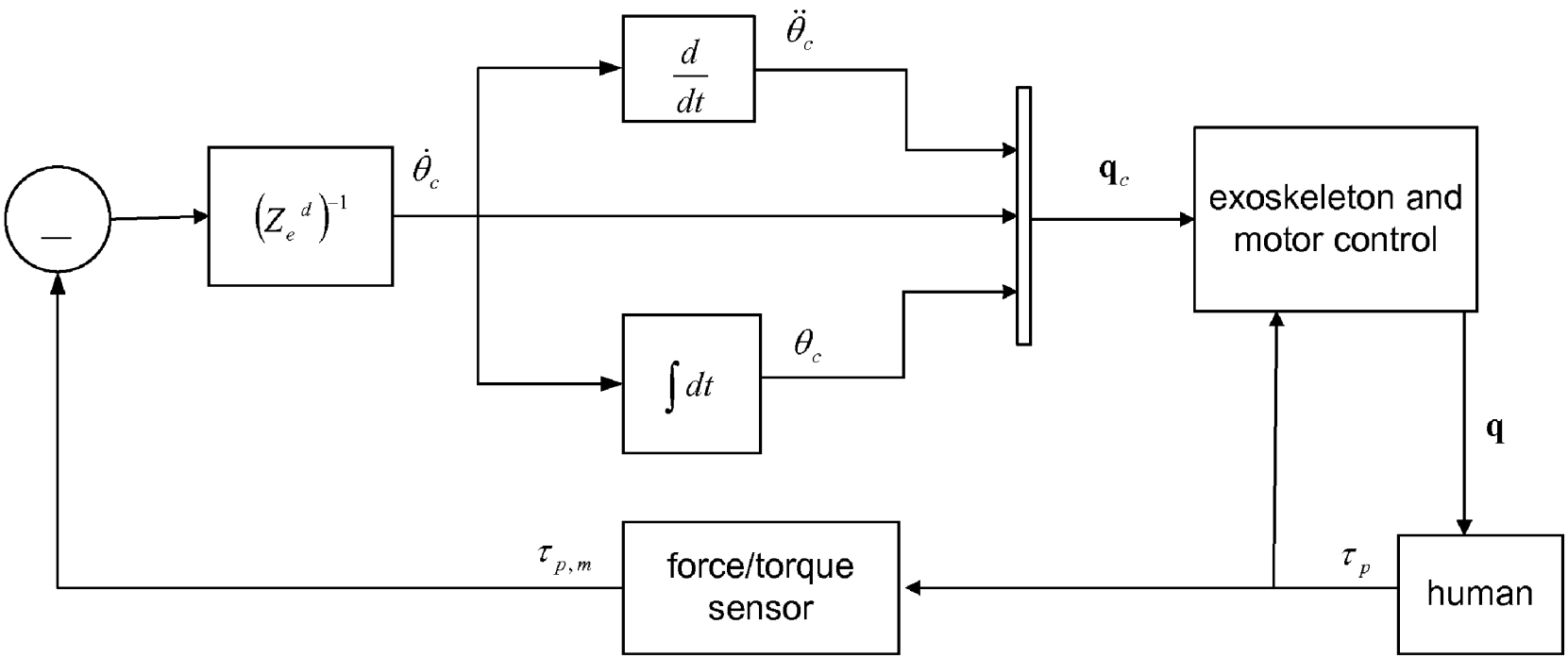
FIG. 9A illustrates an implementation of a 1-DOF assistive controller based on active admittance, according to one embodiment.

Implementing an active impedance controller can be accomplished in a number of ways. In one embodiment, the controller comprises an admittance-based trajectory command generator and a force/torque sensor in a feedback loop with the exoskeleton (including elements to control the actuator's motor) and the user. The structure of this controller is illustrated in FIG. 9A.

The measured interaction torque or interaction force $\tau_{p,m}$ is negated and used as input to an active impedance element containing the virtual impedance parameters of the exoskeleton in the form $1/Z_e^d(s)$ (also known as virtual admittance). The active impedance element generates a commanded angle velocity $\dot{\theta}_c$. The commanded angle velocity is possibly combined with its integral and/or derivative to form a commanded kinematic trajectory $q_c$ (comprising angular position, angular velocity and/or angular acceleration) for the exoskeleton. The "c" subscript refers to "command" because the reference trajectory is commanded to the exoskeleton's motor. The commanded kinematic trajectory and the interaction torque or force $\tau_p$ is used to control the motor of the exoskeleton, possibly through a proportional-integral-derivative (PID) or other control mechanism. As a result of the exoskeleton's motor executing the command, the exoskeleton's actuator moves in a trajectory q (comprising angular position, angular velocity, and/or angular acceleration) and interacts with the human user to produce an interaction torque or force $\tau_p$ that is measured by a torque/force sensor to produce $\tau_{p,m}$ described above.

Figure 9B:
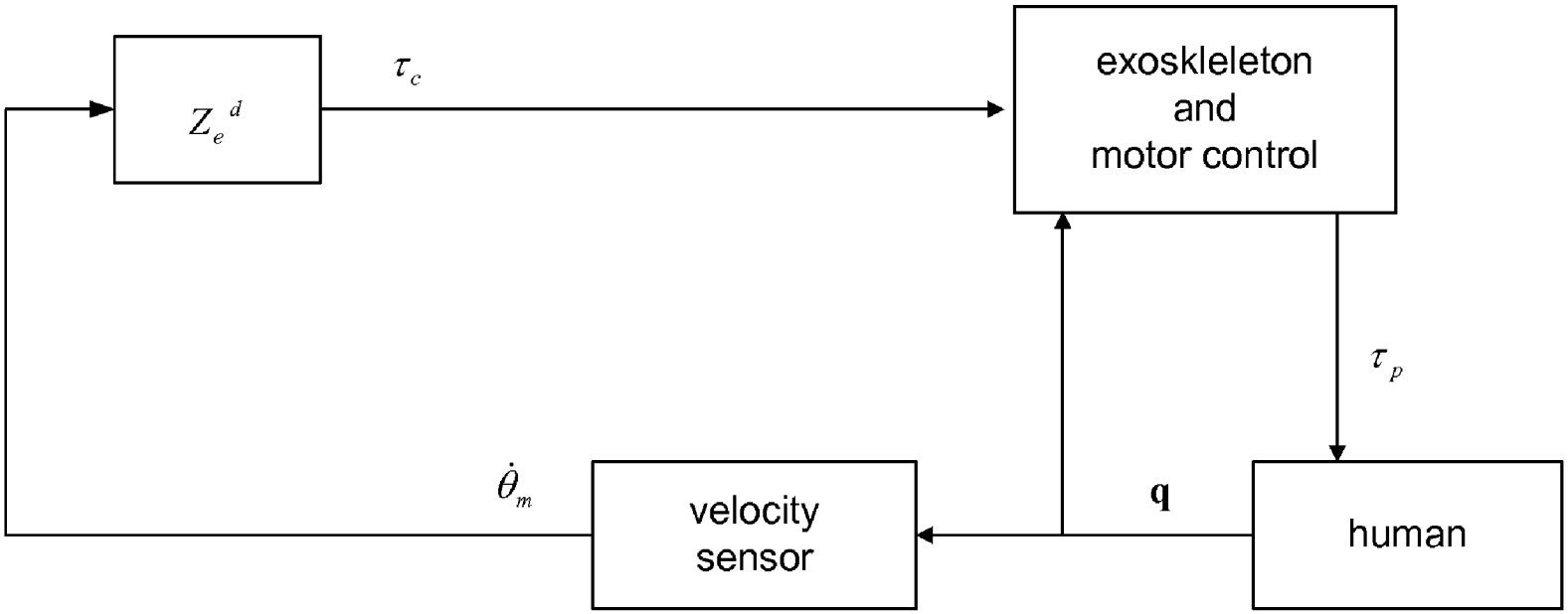
FIG. 9B illustrates an implementation of a 1-DOF assistive controller based on active impedance, according to one embodiment.

In another embodiment, an active impedance controller comprises an impedance-based torque command generator and a velocity sensor in a feedback loop with the exoskeleton (including elements to control the actuator's motor) and the user. The structure of this controller is illustrated in FIG. 9B.

The measured angular velocity $\dot{\theta}_m$ is used as an input to an active impedance element containing the virtual impedance parameters of the exoskeleton in the form $Z_e^d(s)$. The active impedance element generates a commanded actuator torque or force $\tau_c$. The commanded actuator torque or force $\tau_c$ and the actual kinematic trajectory of the joint of the human user q (comprising angular position, angular velocity, and/or angular acceleration) is used to control the motor of the exoskeleton, possibly through a proportional-integral-derivative (PID) or other control mechanism. As a result of the exoskeleton's motor executing the command, the exoskeleton exerts an interaction torque or interaction force $\tau_p$ on the user and the user's joint moves in the kinematic trajectory q which is measured by the velocity sensor to produce $\dot{\theta}_m$ described above.

The active impedance controller is capable of (on average) inputting energy to the user-exoskeleton system. The power exerted by the exoskeleton is the product of the exoskeleton angular velocity (the velocity component of q) and interaction torque ($\tau_p$). The integral of this power is the energy input by the exoskeleton to the system, which is positive on average.

The active impedance controller can be implemented in hardware, software, or both. The signals in the controller may be digital, analog, or both. The modules illustrated in FIGS. 9A and 9B can be combined or further divided into other modules. The impedance controller can be implemented as a part of the exoskeleton, as a part of the exoskeleton's actuator, or separate from the exoskeleton.

4. Assistive Control Based on Active Impedance: Multi-DOF Case

Figure 10:
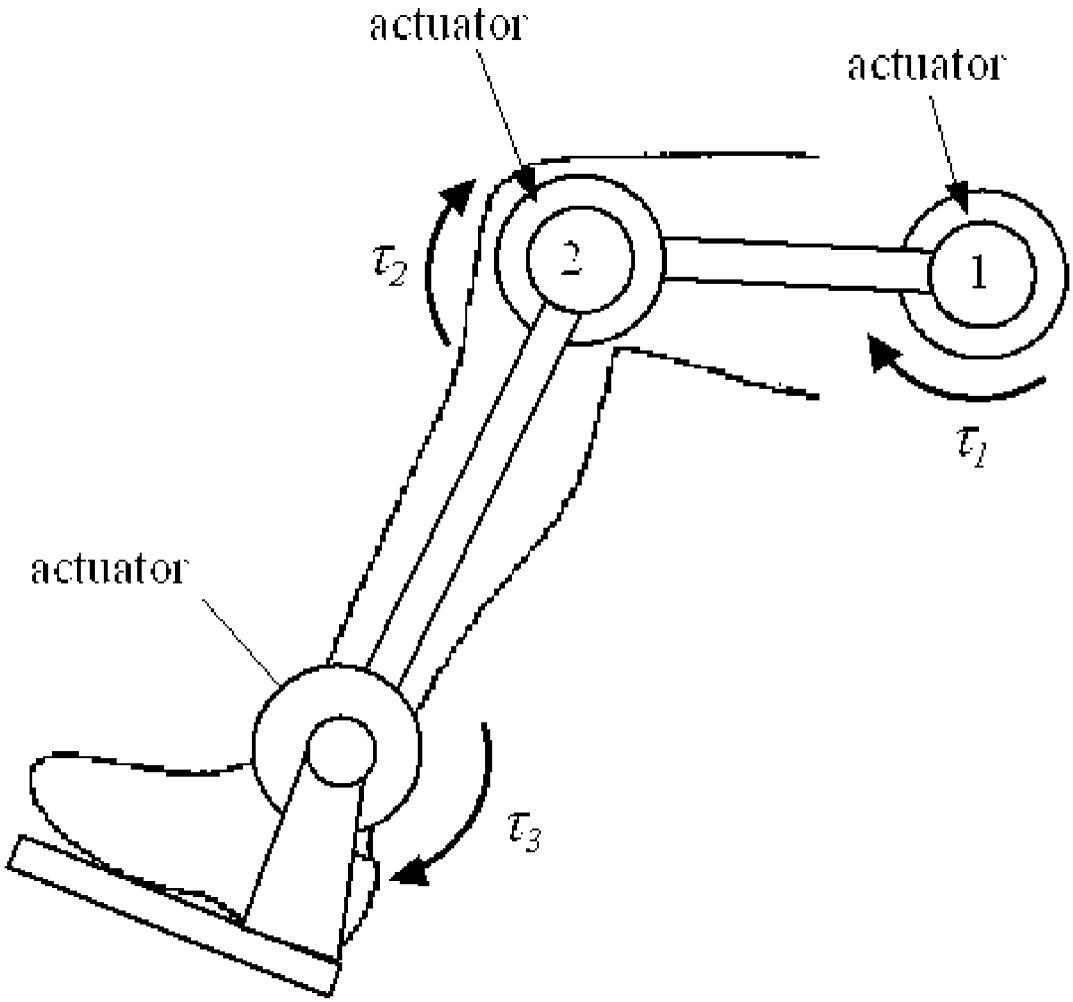
FIG. 10 illustrates an exoskeleton design with multiple degrees of freedom, according to one embodiment.

FIG. 10 illustrates an exoskeleton design with multiple degrees of freedom (multi-DOF), according to one embodiment. The exoskeleton is composed of rigid links connected by movable joints with actuation. Such a device can be used to assist the user in performing the more complex lower-limb motions associated with daily living such as walking, climbing stairs, sitting down, etc. The exoskeleton illustrated in FIG. 10 is a nonlinear system with multiple inputs, $\tau_1$, $\tau_2$, and $\tau_3$, which are the actuators' torques, and multiple outputs, which are the velocity responses of the links. The control methods described in the previous sections can be extended to the multi-DOF exoskeleton.

Figure 11:
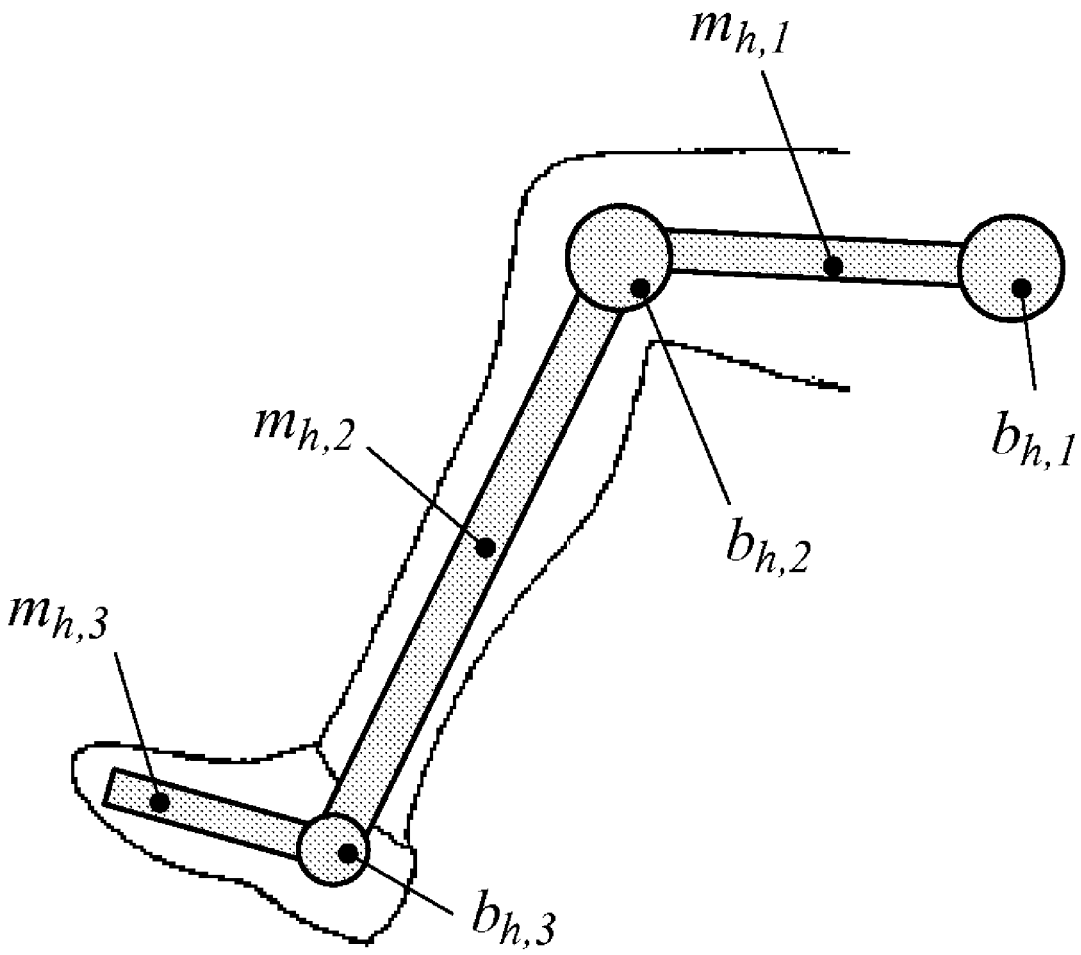
FIG. 11 illustrates human leg impedance parameters, according to one embodiment.

FIG. 11 illustrates the impedance properties of the human limb, according to one embodiment. The leg is represented as a multi-link mechanism characterized by the mass of each link, $m_{h,i}$ (on which the moment of inertia also depends). The link masses can be arranged into a mass vector $m_h$. Each joint is characterized by a damping coefficient, $b_{h,i}$. The damping coefficients can be arranged into a damping matrix $B_h$. (Joint stiffnesses have been left out for clarity.) The exoskeleton is designed to produce a virtual modification of the impedance parameters of the limb, thus reducing the muscle effort needed to move the limb. The modified impedances are represented as a set of virtual masses, $m_h^d$ and damping coefficients, $B_h^d$. Assist can be achieved by making each of the virtual masses $m_h^d$ smaller than its real counterpart in $m_h$. The effect perceived by the user would be the limb weighing less and showing less inertia. Similarly, a virtual reduction in the damping of the joints can be expected to have an assistive effect on the user.

Figure 12:
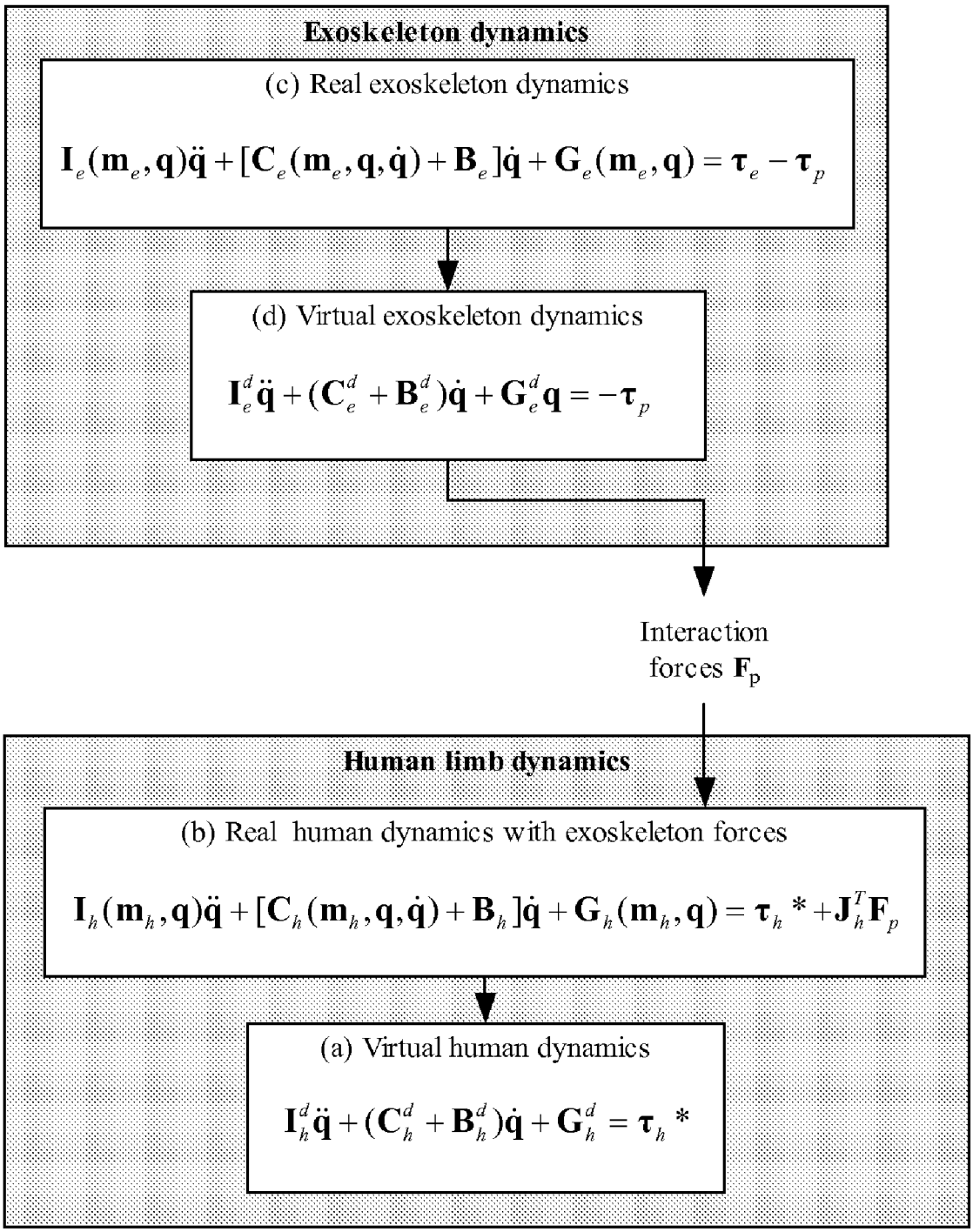
FIG. 12 illustrates the virtual modification of human leg dynamics through an exoskeleton assist, according to one embodiment.

FIG. 12 illustrates, in schematic form, one way in which the controller for the multi-DOF exoskeleton produces the virtual modification in the properties of the human limb. The natural dynamics of the human limb are represented by the following equation:

$$I_h(m_h,q)\ddot{q}+[C_h(m_h,q,\dot{q})+B_h]\dot{q}+G_h(m_h,q)=\tau_h \tag{16}$$

In the above equation, vector q is a set of n generalized coordinates (typically joint angles) representing the configuration of the limb in joint space. $I_h(m_h,q)$ is the inertia matrix of the limb, $C_h(q,\dot{q})$ represents the centrifugal and Coriolis terms, and $G_h(m_h,q)$ represents the gravitational forces acting on the limb. $B_h$ is the damping matrix of the limb, and the vector $\tau_h$ represents the net muscle torques acting on the limb's joints. The effect of the exoskeleton is replacing the limb's natural dynamics by a set of virtual dynamic terms denoted by the superscript d in block (a) of FIG. 12:

$$I_h^d\ddot{q}+(C_h^d+B_h^d)\dot{q}+G_h^d=\tau_h^* \tag{17}$$

where $$I_h^d=I_h(m_h^d,q) \tag{18}$$

$$C_h^d=C_h(m_h^d,\dot{q}) \tag{19}$$

$$G_h^d=G_h(m_h^d,q) \tag{20}$$

One way to produce the virtual impedance of the limb is through the interaction forces $F_p$ (in Cartesian space) between the exoskeleton and the human limb. These forces modify Equation 16 as shown in block (b) of FIG. 12.

$$I_h(m_h,q)\ddot{q}+[C_h(m_h,q,\dot{q})+B_h]\dot{q}+G_h(m_h,q)=\tau_h^*+J_h^TF_p \tag{21}$$

In this equation, $J_h^T$ is the Jacobian matrix of the human limb. The Jacobian matrix relates the Cartesian velocities $\dot{x}$ of the points where the forces $F_p$ are applied, to the limb joints' angular velocities $\dot{q}$. The last term in the above equation can be replaced by a vector of equivalent torques $\tau_p$ in joint space:

$$\tau_p=J_h^TF_p \tag{22}$$

These torques can be measured directly, for instance, by installing torque sensors at the joints. Combining Equations 17, 21, and 22 yields the following equation (with some mass and state terms removed for clarity):

$$(I_h^d-I_h)\ddot{q}+[(C_h^d-C_h)+(B_h^d-B_h)]\dot{q}+(G_h^d-G_h)q=-\tau_p \tag{23}$$

This equation can be expressed in compact form by defining $$I_e^d=I_h^d-I_h,\ C_e^d=C_h^d-C_h,\ B_e^d=B_h^d-B_h,\ G_e^d=G_h^d-G_h \tag{24}$$

We refer to the above terms as the virtual dynamics of the exoskeleton. Thus, $$I_e^d\ddot{q}+(C_e^d+B_e^d)\dot{q}+G_e^dq=-\tau_p \tag{25}$$

As expected, the virtual dynamics of the exoskeleton are those of an active system. For the particular case of a virtual damping matrix $B_e^d$ composed of constant terms, the virtual dynamics of the exoskeleton will be active if $B_e^d$ is proven to be negative definite.

Equation 25, shown also in block (d) of FIG. 12, represents the basic control law for the exoskeleton. As in the case of the 1-DOF exoskeleton, one embodiment of this control law is an impedance controller. In such an impedance controller, given the interaction torque $-\tau_p$ as input, the exoskeleton enforces the kinematic trajectory represented by $\ddot{q}$, $\dot{q}$ and q.

Equation 25 does not represent the real dynamics of the exoskeleton. These are represented instead by the equation in block (c) of FIG. 12:

$$I_e(m_e,q)\ddot{q}+[C_e(m_e,q,\dot{q})+B_e]\dot{q}+G_e(m_e,q)=\tau_e-\tau_p \tag{26}$$

In the above equation, $I_e(m_e,q)$ is the inertia matrix of the exoskeleton, $C_e(q,\dot{q})$ represents the centrifugal and Coriolis terms, and $G_h(m_h,q)$ represents the gravitational forces acting on the exoskeleton. $B_e$ is the damping matrix of the exoskeleton. Vector $\tau_e$ represents the actuators' torques. The controller's task is to replace these dynamics with those from Equation 25. This normally involves the use of state and/or force feedback.

5. Implementation of a Multi-DOF Assistive Controller Based on Active Impedance

One consideration in implementing a control architecture for a multi-DOF exoskeleton is the linearization of the exoskeleton plant, that is, making the dynamic properties of the exoskeleton independent of the inputs to the system. As shown below, linearization can be accomplished through the use of a model of the dynamics of the physical exoskeleton.

Figure 13:
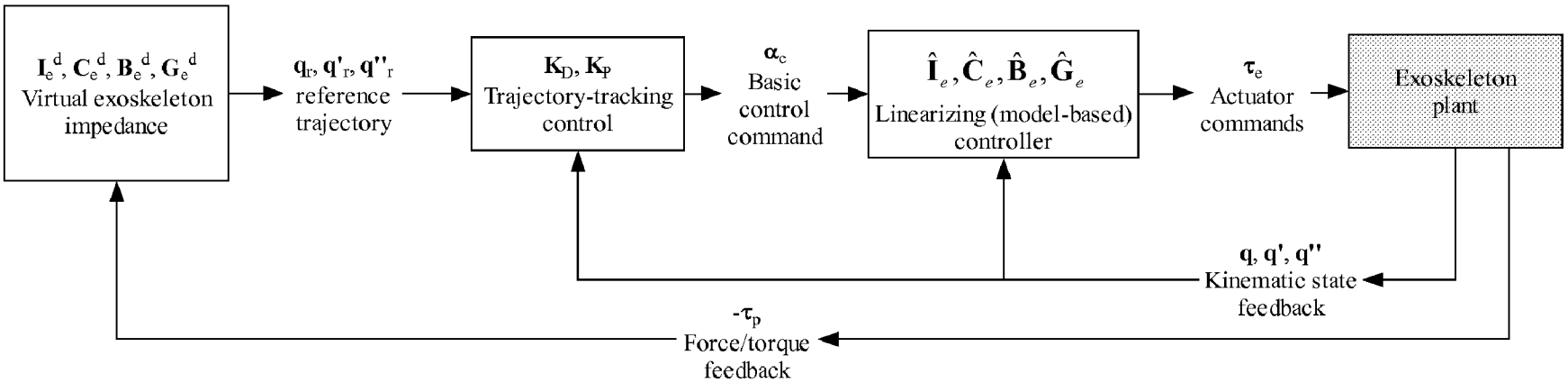
FIG. 13 illustrates a control architecture for the multi-DOF exoskeleton, according to one embodiment.

FIG. 13 illustrates a diagram of the control architecture for the multi-DOF exoskeleton, in one embodiment. The exoskeleton's control comprises three main stages, each of which has its own feedback loop. The first stage is the active impedance element based on the virtual exoskeleton impedance. This element represents the desired dynamic behavior of the exoskeleton. The output of the active impedance element is a reference kinematic trajectory (comprising angular position, angular velocity, and/or angular acceleration) for each of the exoskeleton's actuators. The second stage is the trajectory-tracking controller. This component has the function of issuing the basic control commands necessary for the actuators to follow the reference trajectory. This control block can contain a proportional (P) or proportional-derivative (PD) controller. The third stage is the linearizing (model-based) controller. In the case of a multi-DOF exoskeleton, gravity and coupling between the links are sources of nonlinear dynamics that make the trajectory-tracking control insufficient. This problem is solved by adding a linearizing control that effectively makes the exoskeleton behave as a linear plant. This control stage combines a model of the exoskeleton's true dynamics with kinematic feedback (typically position and velocity) from the physical exoskeleton.

The controller illustrated in FIG. 13 is designed to perform the task outlined in FIG. 12. In one embodiment, the first control stage comprises an active impedance element based on equation 25. This element receives the measured interaction torque $-\tau_p$ and generates a reference acceleration trajectory $\ddot{q}_r$. Successive integrations of this term generate a reference velocity $\dot{q}_r$ and a reference position $q_r$.

The second stage is the trajectory-tracking controller (outer-loop control), for example a PD controller that applies the control law $$\alpha_c=\ddot{q}_r+K_D\dot{e}_r+K_Pe_r \tag{27}$$

where $\dot{e}_r$ and $e_r$ are, respectively, the velocity error and the position error. $K_D$ and $K_P$ are scalar gain matrices. $\alpha_c$ is the commanded acceleration input to the exoskeleton.

The third stage is a model-based controller that translates the commanded acceleration into torque commands $\tau_e$ for the actuators. Linearization of the exoskeleton also takes place at this stage. On the basis of Equation 26, the control law for the third stage is given by $$\tau_e=\hat{I}_e(m_e,q)\ddot{q}+[\hat{C}_e(m_e,q,\dot{q})+\hat{B}_e]\dot{q}+\hat{G}_e(m_e,q) \tag{28}$$

The terms $\hat{I}_e(q)$, $\hat{C}_e(q,\dot{q})$, $\hat{B}_e$ and $\hat{G}_e(q)$ constitute the model of the exoskeleton's real dynamics. Provided that the model terms are sufficiently accurate, the third stage of the controller yields a cancellation of the nonlinear terms in Equation 26. The resulting behavior of the physical exoskeleton is thus given by $$\ddot{q}=\alpha_c-I_e(m_e,q)^{-1}\tau_p \tag{29}$$

The above equation shows that the exoskeleton's kinematic response $\ddot{q}$ is linear to the inputs $\alpha_c$ (control) and $-\tau_p$ (interaction torque).

Although the invention has been described in considerable detail with reference to certain embodiments thereof, other embodiments are possible as will be understood to those skilled in the art.

What is claimed is:

1. A method for controlling an actuator of an exoskeleton with a controller, comprising:

the controller receiving a desired mechanical impedance function of the exoskeleton, the desired mechanical impedance function comprising a desired relationship between forces applied to the exoskeleton and resulting angular velocities of the exoskeleton at various frequencies;

the controller receiving a measured interaction force, wherein the measured interaction force represents an interaction between the exoskeleton and a limb segment of a user wearing the exoskeleton; and controlling a kinematic trajectory of the actuator with the controller based on the measured interaction force using impedance control to implement the desired mechanical impedance function of the exoskeleton, the desired mechanical impedance function of the exoskeleton being an active impedance function that causes the exoskeleton to be assistive to the user wearing the exoskeleton by reducing a muscle torque required to move the limb segment, the desired mechanical impedance function comprising a negative exoskeleton impedance component, wherein the negative exoskeleton impedance component is determined by estimating a limb impedance component of the limb segment of the user and by negatively scaling the estimated limb impedance component based on a degree of reduction of the muscle torque required to move the limb segment.

2. The method of claim 1, wherein the negative exoskeleton impedance component comprises one from the set of: a negative desired inertia moment of the exoskeleton, a negative desired damping of the exoskeleton, and a negative desired stiffness of the exoskeleton.

3. The method of claim 2, wherein the negative exoskeleton impedance component is out of phase with a limb impedance component of the limb segment of the user by 180 degrees.

4. The method of claim 1, wherein the kinematic trajectory of the actuator comprises an angular velocity of the actuator.

5. A method for controlling an actuator of an exoskeleton with a controller, comprising:

the controller receiving a desired mechanical impedance function of the exoskeleton, the desired mechanical impedance function comprising a desired relationship between forces applied to the exoskeleton and resulting angular velocities of the exoskeleton at various frequencies;

the controller receiving a measured angular velocity of a limb segment of a user wearing the exoskeleton; and controlling a force of the actuator with the controller based on the measured angular velocity using impedance control to implement the desired mechanical impedance function of the exoskeleton, the desired mechanical impedance function of the exoskeleton being an active impedance function that causes the exoskeleton to be assistive to the user wearing the exoskeleton by reducing a muscle torque required to move the limb segment, the desired mechanical impedance function comprising a negative exoskeleton impedance component, wherein the negative exoskeleton impedance component is determined by estimating a limb impedance component of the limb segment of the user and by negatively scaling the estimated limb impedance component based on a degree of reduction of the muscle torque required to move the limb segment.

6. The method of claim 5, wherein the negative exoskeleton impedance component comprises one from the set of: a negative desired inertia moment of the exoskeleton, a negative desired damping of the exoskeleton, and a negative desired stiffness of the exoskeleton.

7. The method of claim 6, wherein the negative exoskeleton impedance component is out of phase with a limb impedance component of the limb segment of the user by 180 degrees.

8. A controller for controlling an actuator of an exoskeleton, the controller comprising:

a processor; and a computer-readable storage medium storing computer program modules executable on the processor, the modules configured for:

receiving a desired mechanical impedance function of the exoskeleton, the desired mechanical impedance function comprising a desired relationship between forces applied to the exoskeleton and resulting angular velocities of the exoskeleton at various frequencies;

receiving a measured interaction force, wherein the measured interaction force represents an interaction between the exoskeleton and a limb segment of a user wearing the exoskeleton; and controlling a kinematic trajectory of the actuator based on the measured interaction force using impedance control to implement the desired mechanical impedance function of the exoskeleton, wherein the desired mechanical impedance function of the exoskeleton being an active impedance function that causes the exoskeleton to be assistive to the user wearing the exoskeleton by reducing a muscle torque required to move the limb segment, the desired mechanical impedance function comprising a negative exoskeleton impedance component, wherein the negative exoskeleton impedance component is determined by estimating a limb impedance component of the limb segment of the user and by negatively scaling the estimated limb impedance component based on a degree of reduction of the muscle torque required to move the limb segment.

9. The controller of claim 8, wherein the negative exoskeleton impedance component comprises one from the set of: a negative desired inertia moment of the exoskeleton, a negative desired damping of the exoskeleton, and a negative desired stiffness of the exoskeleton.

10. The controller of claim 9, wherein the negative exoskeleton impedance component is out of phase with a limb impedance component of the limb segment of the user by 180 degrees.

11. The controller of claim 8, wherein the kinematic trajectory of the actuator comprises an angular velocity of the actuator.

12. A controller for controlling an actuator of an exoskeleton, the controller comprising:

a processor; and a computer-readable storage medium storing computer program modules executable on the processor, the modules configured for:

receiving a desired mechanical impedance function of the exoskeleton, the desired mechanical impedance function comprising a desired relationship between forces applied to the exoskeleton and resulting angular velocities of the exoskeleton at various frequencies;

receiving a measured angular velocity of a limb segment of a user wearing the exoskeleton; and controlling a force of the actuator based on the measured angular velocity using impedance control to implement the desired mechanical impedance function of the exoskeleton, the desired mechanical impedance function of the exoskeleton being an active impedance function that causes the exoskeleton to be assistive to the user wearing the exoskeleton by reducing a muscle torque required to move the limb segment, the desired mechanical impedance function comprising a negative exoskeleton impedance component, wherein the negative exoskeleton impedance component is determined by estimating a limb impedance component of the limb segment of the user and by negatively scaling the estimated limb impedance component based on a degree of reduction of the muscle torque required to move the limb segment.

13. The controller of claim 12, wherein the negative exoskeleton impedance component comprises one from the set of: a negative desired inertia moment of the exoskeleton, a negative desired damping of the exoskeleton, and a negative desired stiffness of the exoskeleton.

14. The controller of claim 13, wherein the negative exoskeleton impedance component is out of phase with a limb impedance component of the limb segment of the user by 180 degrees.

* * * * *